US005133173A

United States Patent [19]

Draghetti et al.

[11] Patent Number: 5,133,173

[45] Date of Patent: Jul. 28, 1992

[54] METHOD AND EQUIPMENT FOR WRAPPING GROUPS OF PACKETS

[75] Inventors: Fiorenzo Draghetti, Medicina; Silvano Boriani, Bologna, both of Italy

[73] Assignee: G.D. Societa per Azioni, Bologna, Italy

[21] Appl. No.: 679,235

[22] Filed: Apr. 2, 1991

[30] Foreign Application Priority Data

Apr. 2, 1990 [IT] Italy ..... 3422 A/90

[51] Int. Cl.[5] ..... B65B 11/12

[52] U.S. Cl. ..... 53/466; 53/449; 53/73; 53/171; 53/230

[58] Field of Search ..... 53/55, 57, 73, 77, 171, 53/228, 230, 449, 466, 498, 500, 575

[56] References Cited

U.S. PATENT DOCUMENTS

| | | | |
|---|---|---|---|
| 2,277,408 | 3/1942 | Molins et al. | 53/73 |
| 2,844,929 | 7/1958 | Ringler | 53/230 |
| 2,931,487 | 4/1960 | Frank et al. | 53/73 |
| 3,253,385 | 5/1966 | Beermann et al. | 53/55 |
| 3,324,624 | 6/1967 | Mayer | 53/230 |
| 3,344,578 | 10/1967 | Anderson | 53/54 |
| 3,495,820 | 2/1970 | Seragnoli . | |
| 3,507,089 | 4/1970 | Mizelle et al. | 53/230 X |
| 4,653,248 | 3/1987 | Bergher et al. | 53/231 |
| 4,885,895 | 12/1989 | Focke et al. | 53/73 |
| 4,932,190 | 6/1990 | Bergher et al. | 53/57 X |

FOREIGN PATENT DOCUMENTS

| | | | |
|---|---|---|---|
| 647979 | 9/1962 | Canada | 53/57 |
| 312969 | 6/1929 | United Kingdom . | |
| 1022312 | 3/1966 | United Kingdom . | |
| 1349244 | 4/1974 | United Kingdom . | |
| 1384722 | 2/1975 | United Kingdom . | |
| 1484486 | 9/1977 | United Kingdom . | |
| 2112360 | 7/1983 | United Kingdom . | |
| 2213456 | 8/1989 | United Kingdom . | |

*Primary Examiner*—Robert L. Spruill
*Assistant Examiner*—Daniel B. Moon
*Attorney, Agent, or Firm*—Cushman, Darby & Cushman

[57] ABSTRACT

Packets of cigarettes are directly singly and in succession along a conveyor into a cellophane wrapping machine, and thereafter to a packaging machine which is driven, together with the wrapping machine, by one main motor and incorporates a feed unit supplying wrapper blanks, and a wrapping unit by which each blank is folded about a corresponding group of packets. In the event of an interruption in the supply of packets to the conveyor, the feed unit is decoupled automatically from the main motor and the wrapping unit then allowed to complete a further cycle in which a blank already gummed and positioned by the feed unit can be fashioned as usual into an outer wrapper around a relative group of packets before the main motor is finally shut off.

12 Claims, 3 Drawing Sheets

METHOD AND EQUIPMENT FOR WRAPPING GROUPS OF PACKETS

BACKGROUND OF THE INVENTION

The present invention relates to a method by which to envelop groups of packets in an outer wrapping. Conventionally, packets of cigarettes are wrapped in groups utilizing a cellophane wrapping machine in conjunction with a packaging machine; a first wrapper is fashioned around the individual packets and a second wrapper is then formed around a group composed of a given number of packets.

In a conventional packaging machine, the second wrapper is applied internally of a unit to which sheets, or blanks of wrapping material are supplied singly and in succession and then folded around the groups of packets by steps effected in a plurality of cycles, implemented by the selfsame packaging machine. In the course of the operation of such a packaging machine, the runout channel from the wrapping unit remains occupied at any given moment by a plurality of groups, each enveloped by a wrapper gummed previously at selected points and in the process of being folded and secured.

In most cases, the cellophane wrapping machine and the packaging machine are driven by a single motor which, in the event that the supply of packets to the cellophane wrapping unit should be adversely affected in any way, will shut off and thus cause both the machines to cease operation; as a result, any unfinished wrappers still occupying the runout channel will be jettisoned as rejects, incurring a significant penalty in terms of cost.

SUMMARY OF THE INVENTION

An object of the present invention is to enable the formation of wrappers around grouped packets of cigarettes in equipment of the type in question, without encountering the drawback mentioned above in the event of a break in the supply of packets of cigarettes to the cellophane wrapping unit.

The stated object is realized, according to the present invention, in a method of the type whereby outer wrappers are fashioned by folding sheets of material around groups of packets internally of a packaging machine, supplied with the packets by an infeed conveyor and comprising a wrapping unit by which single blank sheets of wrapping material are folded around respective groups of packets entering the wrapping unit in succession by way of the same infeed conveyor, a feed unit by which the blanks are supplied to the wrapping unit, main drive means common to the feed unit and the wrapping unit, and applicator means for gumming selected sections of the blanks. Any deactivation of the main drive means occasioned by an absence of packets from the infeed conveyor is preceded by a procedure comprising the steps of decoupling the feed unit from the main drive means, and allowing the wrapping unit only to continue operating, powered by the main drive means, until such time as any blank remaining in the wrapping unit has been folded into a finished wrapper around a relative group of packets.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
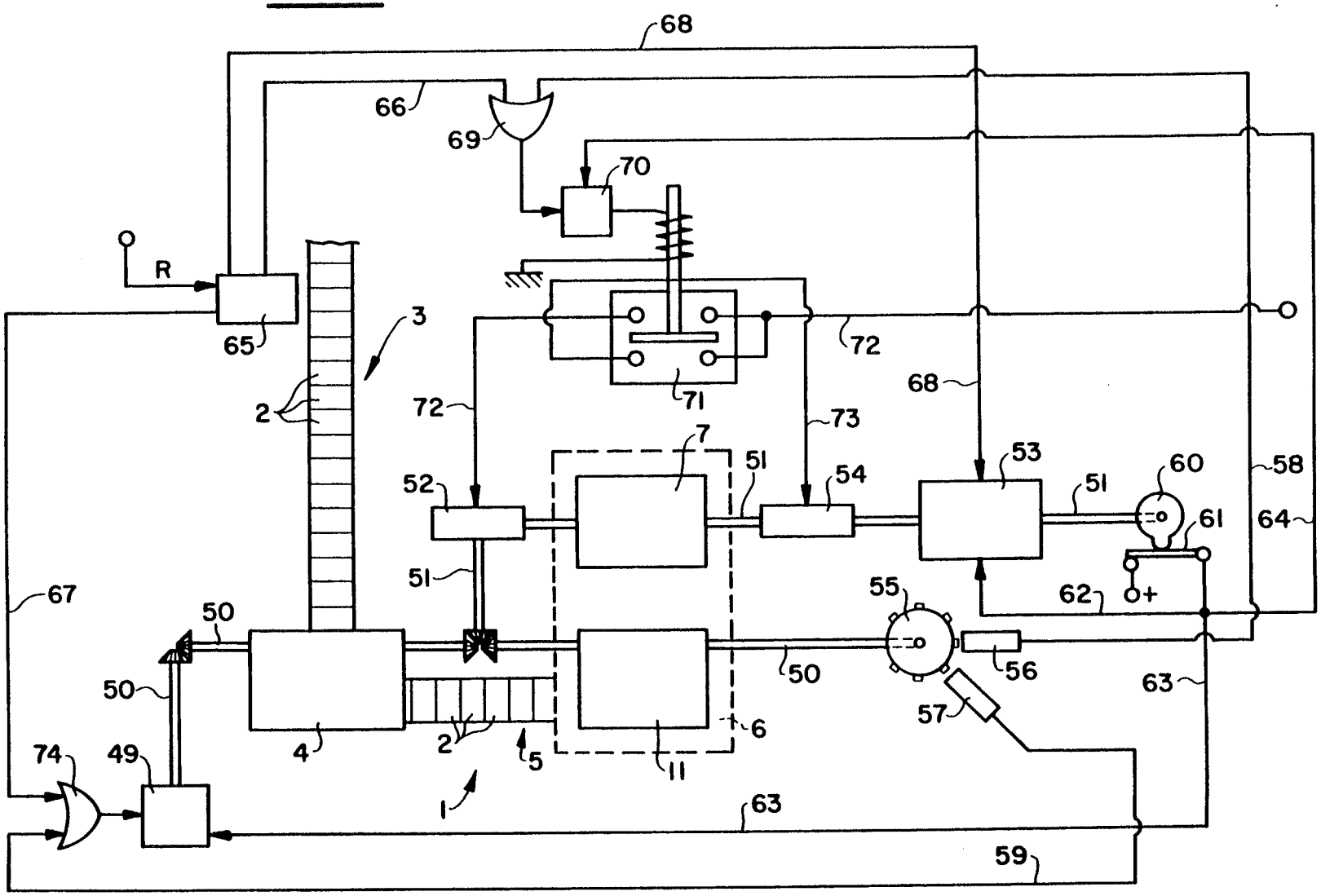
FIG. 1 provides a schematic and block diagram of equipment for wrapping packets of cigarettes in groups, according to the present invention.

In FIG. 1 of the drawings, 1 denotes equipment, in its entirety, by means of which to envelop packets of cigarettes 2 in an outer wrapping.

Such equipment 1 comprises an infeed conveyor 3, along which packets 2, upon arrival from a packeting machine (not illustrated) are directed singly and in succession to a cellophane wrapping machine 4 of the type designed to fashion a first individual transparent wrapping (not illustrated) around each packet 2 and then to transfer the packets singly and in succession along a further conveyor 5 to a packaging machine 6.

Figure 2:
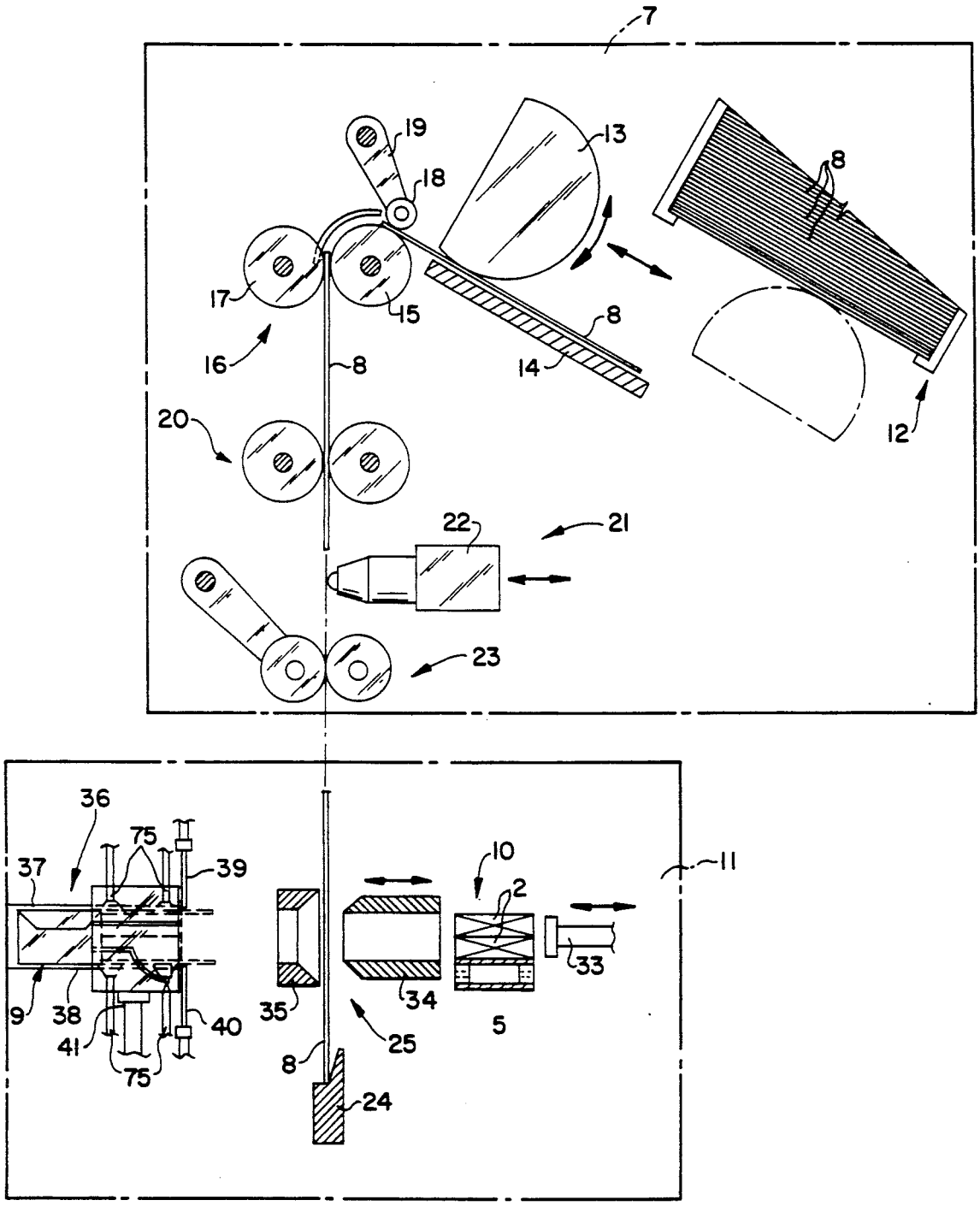
FIG. 2 is the schematic representation of a detail of a wrapping unit forming part of equipment as in FIG. 1, seen in elevation.

With reference to FIG. 2 in particular, 7 denotes a feed unit designed to supply the packaging machine 6 with blank sheets 8 of material for formation into wrappers 9, each ultimately enveloping a group 10 of packets 2 arranged in the manner illustrated. The packaging machine 6 also includes a wrapping unit 11 by which each blank 8 is folded around a relative group 10 of packets to form the finished wrapper 9.

As shown in FIG. 2, the feed unit 7 comprises a loader 12 holding a supply of blanks 8 stacked one on top of another, which are drawn off singly from one end of the stack by a vacuum sector 13 of the type disclosed in U.S. Pat. No. 3,495,820. Rotating about its own axis, the sector 13 picks up the single blank 8 at the bottom of the loader 12 and then traverses parallel to the axis of rotation to a point where the blank 8 is released onto a bearing surface 14, its leading edge lying tangential to the driving roller 15 of a first feed mechanism 16 which also comprises a further roller 17 breasted in rotation with the driving roller 15.

The numeral 18 denotes a pressure roller, located above the driving roller 15 and the bearing surface 14 and mounted rotatably to one end of a lever 19. The pressure roller 18 is free to oscillate about the fulcrum of the lever between a raised position, at rest, and a lowered operative position in which the blank 8 is pinched between the pressure roller 18 and the driving roller 15 and thus carried forward by the driving roller 15 to be taken up by the feed mechanism 16.

With each cycle executed by the feed unit 7, the sector 13 carries forward one blank 8 to a ready position, resting on the bearing surface 14 with its leading edge between the driving and pressure rollers 15 and 18, while the leading edge of the blank 8 previously occupying the ready position is advanced by the feed mechanism 16 downwards through a substantially vertical trajectory toward an exit position, upon arrival at which the blank 8 lies with its trailing edge still retained by the first feed mechanism 16 and its leading end taken up between the rollers of a further feed mechanism 20.

Continuing with describing the structure shown in FIG. 2, the feed unit 7 further comprises a gumming device 21 consisting in a ball-point type applicator 22 capable of axial movement toward and away from the vertical path followed by the blanks, located following the second feed mechanism 20 and preceding a further set of rollers 23 constituting an outfeed mechanism. This third mechanism 23 is designed to take up successive blanks 8 from the second feed mechanism 20 and supply them to the wrapping unit 11.

Once in the wrapping unit 11, the blank 8 descends into a final feed position, registering against a stop denoted 24 and occupying a folding station 25 located adjacent to the path of the conveyor 5; the conveyor passes alongside and perpendicular to the vertical trajectory mentioned above, in alignment with a central section 26 (see FIG. 3) of a blank 8 occupying the final feed position, i.e. with its leading edge in contact with the stop 24.

The frequency with which blanks 8 are drawn from the loader 12 is such that, whenever one blank 8 occupies the final feed position with its leading edge in contact with the stop 24, the next blank in succession descending along the vertical trajectory occupies the exit position, prior to abandoning the feed unit 7, and the second next blank 8 occupies the ready position on the bearing surface 14.

Figure 3:
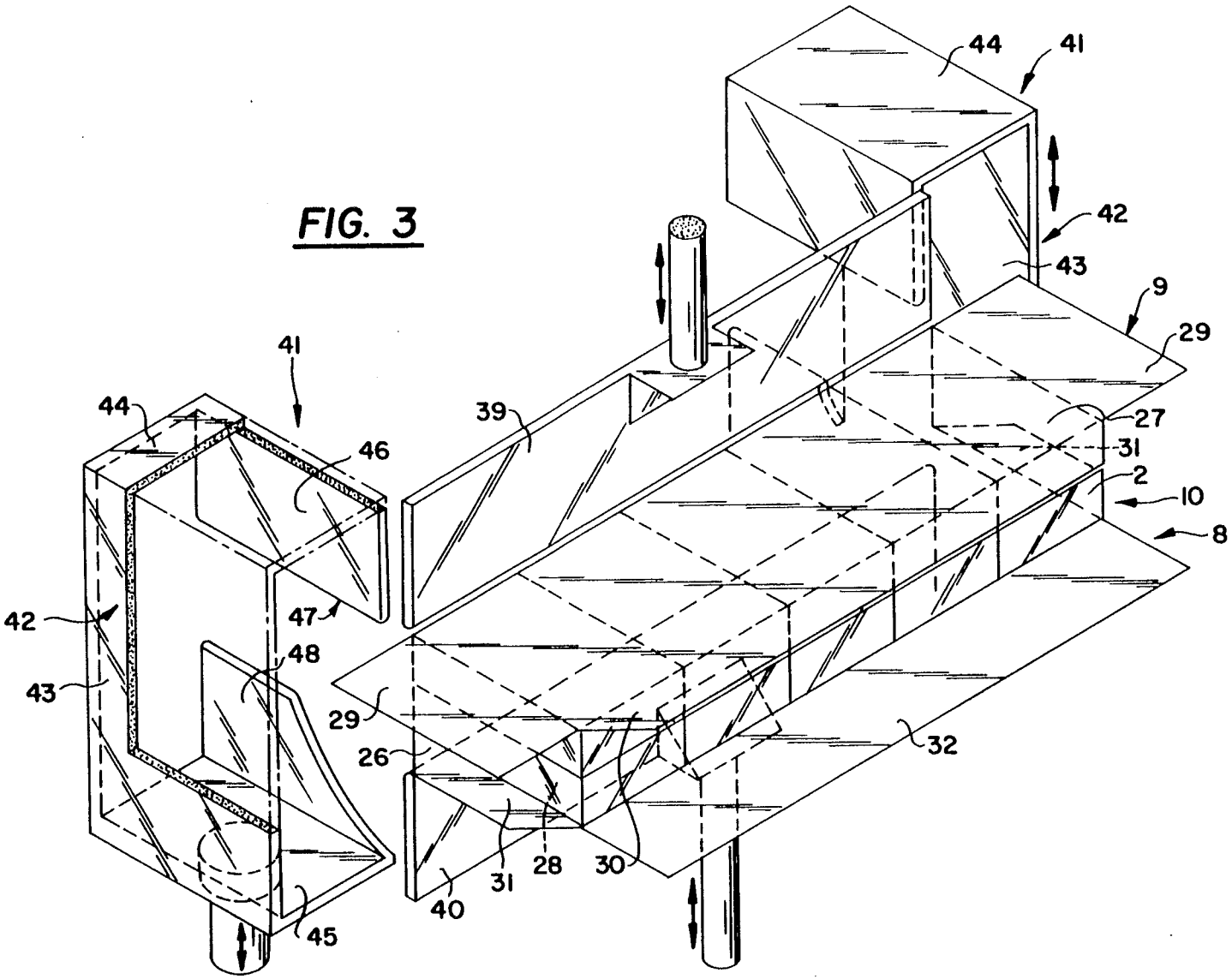
FIG. 3 is the schematic illustration of a detail of FIG. 2, enlarged and viewed in perspective.

The blank 8 utilized may be of any given type, and is illustrated in FIG. 3 in a general embodiment. In addition to the central section 26 mentioned above, which coincides with one side face of the finished wrapper 9, the blank 8 comprises a top section 27 and a bottom section 28 coinciding respectively with the top and the bottom face of the wrapper 9. The top section 27 presents two end flaps 29 and a longitudinal flap 30, while the bottom section 28 presents two end flaps 31 (which may be omitted in certain instances), each of which combines with the corresponding end flap 29 of the top section to constitute a relative end face of the wrapper, and a longitudinal flap 32 that folds upward to combine with the longitudinal flap 30 of the top section in fashioning the side face of the wrapper 9 opposite that afforded by the central section 26.

Referring again to FIG. 2, a group 10 of packets 2 fed by the conveyor 5 into the folding station 25 occupies a position between a push rod 33, disposed transversely to the conveyor, and a hollow fold-former 34 disposed coaxial to the push rod 33 and transversely in relation to a blank 8 occupying the final feed position. As one group 10 is ejected and a successive group 10 enters the station 25, the fold-former 34 is moved axially toward the waiting blank 8, by actuator means (not illustrated in the drawings), to the point where the central section 26 is engaged and urged against a fixed hollow folder denoted 35, through which the blank 8 is forced progressively, assuming a substantially Vee-shaped profile as the top and bottom sections 27 and 28 fold in, following the respective top and bottom external profiles of the former 34.

Before this folding operation on the blank 8 is completed, a successive group 10 advances into the position of alignment with the push rod 33, and the rod is then actuated to remove this group 10 from the conveyor 5 and impinge laterally on the central portion 26 of the corresponding blank 8 by way of the fold-former 34. Movement of the fold-former 34 ceases at this juncture, the push rod 33 continuing forward to the point of driving the partly-enveloped group 10 of packets 2 fully beyond the former 34 and carrying it together with the blank 8 through the fixed folder 35 and into a final fold position, occupying the mouth of a runout channel 36.

The channel 36 includes in a top plate 37 and a bottom plate 38 between which a succession of the groups 10 enveloped in their relative wrappers 9 are detained and indexed forward in the runout direction each time a partly enveloped group 8, 10 enters the mouth of the channel.

Upon arrival of a partly enveloped group 8, 10 in the final fold position, the plates 37 and 38 engage only the top and bottom sections 27 and 28 of the blank 8, whereas the flaps 29, 30 and 31, 32, spread with a layer of gum by the applicator 22, remain projecting outwards.

Observing FIG. 3, from which the runout channel 36 is omitted in the interests of simplicity, it will be seen that the final shaping of the wrapper 9 is not deferred, and completed subsequently with the partly enveloped group 8, 10 progressing along the runout channel as occurs in conventional machines, but is effected in a single operating cycle while the group 10 occupies the final fold position, before the next partly enveloped group 8, 10 is indexed. To this end, the mouth of the runout channel 36 incorporates a top folder 39 and a bottom folder 40 disposed transversely to the axis of the channel and invested with reciprocating movement in the vertical direction. In addition, two end folders 41 are located one on either side of the mouth of the channel 36 and, likewise invested with reciprocating vertical movement.

As discernible from FIG. 3, each end folder 41 comprises a U-profile bracket 42 disposed with its hollow internal face directed toward the channel 36 and including a vertical central web 43 with two substantially rectangular plates 44 and 45 projecting from the top and bottom ends of the web and extending parallel with the plates 37 and 38 of the channel. More exactly, the end folder 41 is designed to assume an at-rest position in which the lower plate 45 is disposed substantially within the same plane as that occupied by the bottom channel plate 38, while the plate 44 uppermost is disposed at a level higher than that of the corresponding channel plate 37. The projecting edge of this same upper plate 44 carries a rectangular blade 46, disposed vertically and parallel with the axis of the channel 36, of which the straight bottom edge 47 lies essentially in the same plane as that occupied by the top plate 37 of the channel 36 when the end folder 41 is in the at-rest position. Similarly, the projecting edge of the bottom plate 45 carries an upwardly projecting blade 48, of curved profile, disposed within the same plane as that occupied by the top blade 46.

When a partly enveloped group 8, 10 is advanced from the position illustrated in FIG. 3 toward the final fold position illustrated in FIG. 2, the two lower end flaps 31 enter progressively into contact with the curved profile of the relative blades 48 and are bent upwards. As the group 8, 10 pauses in the mouth of the channel 36, the two end folders 41 are set in motion, first in a downwards direction in such a way that the top end flaps 29 are engaged by the relative blades 46, flattened and stuck to the outermost surfaces of the end flaps 31 folded previously, then returning upwards to a position whereby the flaps 29 are held firm in the flattened position of adhesion with the flaps 31 beneath. Next, the top folder 39 descends to flatten the top longitudinal flap 30 and then reascends, whereupon the bottom folder 40 ascends to flatten the gummed bottom longitudinal flap 32 against the outermost surface of the folded top flap 30.

The numeral 75 denotes suction means communicating by way of the top and bottom channel plates 37 and 38 with the mouth of the runout channel 36.

The suction means 75 serve to pin the top and the bottom section 27 and 28 of the blank 8 during the folding operations, in such a way as to prevent the shifting of any parts of the wrapper 9 from their prescribed positions.

Referring again to FIG. 1, the cellophane wrapping machine 4 and the packaging machine 6 constitute a single operating unit set in motion by a single motor 49 turning a single drive shaft 50 from which power is taken off to all the moving parts of the two machines 4 and 6. In particular, the cellophane wrapping machine 4 is coupled directly to the drive shaft 50, whereas in the case of the packaging machine 6, the wrapping unit 11 is coupled directly to the shaft 50 and the feed unit 7 operated by a secondary shaft 51 in receipt of power from the main drive shaft 50 by way of first coupling means 52, which may be constituted by a clutch assembly of conventional type. The feed unit 7 is also connected through the secondary shaft 51 to an auxiliary motor 53, by way of second coupling means 54, likewise preferably provided by a clutch assembly of conventional type, for example an electromagnetic clutch.

The angular movement of the main drive shaft 50 is sensed by a rotary encoder 55 carrying a plurality of uniformly spaced inductive elements and geared-down in such a way that the elements index through one step with each revolution of the shaft 50. The encoder 55 is designed to relay two control signals coinciding with each cycle of the machine, by way of two respective output terminals 56 and 57 and two corresponding circuits 58 and 59, upon arrival of the blanks 8 in the positions illustrated in FIG. 2, i.e. a first on the bearing surface 14 in the ready position, a second in the exit position and a third in the final feed position.

The numeral 60 denotes a cam keyed to the secondary shaft 51 and serving to operate a switch 61 with each full revolution of the shaft, thereby causing a further control signal to be relayed through three circuits denoted 62, 63 and 64.

The numeral 65 denotes a sensor positioned alongside the infeed conveyor 3 in such a way as to verify the presence of packets 2 on the conveyor, and designed to emit a continuous signal by way of two circuits 66 and 67 in the absence of any packets 2. Similarly, a signal is relayed by way of a further circuit 68 when packets 2 are sensed.

The signal directed from the encoder 55 through the circuit denoted 58 and the signal directed from the sensor 65 through the circuit denoted 66 combine to drive an AND gate 69. The AND output is directed into a control unit 70 and used to pilot a bistable switch 71 of which one stable function is to keep the first clutch 52 normally connected to a power supply via the circuit 72 and thus ensure the transmission of movement from the drive shaft 50, hence from the motor 49, to the secondary shaft 51. When activated by the signal from the AND gate 69, the switch 71 shifts to a second position whereby the first clutch 52 is isolated from the power supply and the secondary shaft 51 thus decoupled from the drive shaft 50, and power is transferred through a further circuit 73 to the second clutch 54 in such a way as to couple the secondary shaft 51 to the auxiliary motor 53. The signal directed from the encoder 55 through the circuit denoted 59 and the signal directed from the sensor 65 through the circuit denoted 67 combine to drive a further AND gate 74 the output signal of which shuts off the main motor 49.

The signal generated by the sensor 65 through the remaining circuit 68, in response to a signal R signifying restoration of the supply of packets 2 along the infeed conveyor 3, is used to start the auxiliary motor 53.

The control signal generated by the cam-operated switch 61 is directed by way of the three relative circuits 62, 63, 64 respectively to the auxiliary motor 53, which is shut off by the signal, to the main motor 49, which is started by the signal, and to the control unit 70 of the bistable switch 71 which is reset to the normal operating condition whereby the secondary shaft 51 is coupled to the drive shaft 50 and decoupled from the auxiliary motor 53.

In normal operating conditions with a supply of packets 2 advancing along the conveyor 3, the feed unit 7, driven by the secondary shaft 51 through the first clutch assembly 52, proceeds to supply a succession of single blanks 8 through the gumming device 21 and into the folding station 25 of the wrapping unit 11 in the manner described above, furnishing one blank per machine cycle, i.e. for each complete revolution of the shafts 50 and 51. Once in the final feed position and in contact with the stop 24, each successive blank 8 is folded onto a respective group 10 of packets 2 in the manner already described, whereupon the partly enveloped group 8, 10 is directed forward into the mouth of the runout channel 36 and the wrapping completed by flattening and securing the flaps with the various folders 39, 40 and 41.

In the event of a break in the supply of packets 2 along the infeed conveyor 3, the sensor 65 will relay two continuous signals through the relative circuits 66 and 67 to activate the two AND gates 69 and 74. The packaging machine 6 continues operating normally until such time as the encoder 55 releases a signal through the terminal denoted 56 to open the relative AND gate 69, thus triggering operation of the bistable switch 71 to disengage the first clutch 52 and engage the second clutch 54. A signal is activated through this terminal 56 as long as there are blanks 8 occupying the positions as shown in FIG. 2, i.e. a first on the bearing surface 14 in the ready position, a second in the exit position and about to engage the gumming device 21, and a third already gummed and occupying the final feed position with its leading edge in contact with the stop 24.

In practice, operation of the bistable switch 71 has the effect of disconnecting the feed unit 7 from the drive shaft 50, thereby freezing the two blanks 8 occupying the ready position and the exit position. Because the feed unit 7 is connected by way of the second clutch 54 to the auxiliary motor 53, the motionless motor acts as a mechanical brake on the secondary shaft 51, holding it in an angular position whereby the cam 60 is maintained in a position immediately beyond the open switch 61.

The main motor 49 continues to drive the cellophane wrapping machine 4 and the wrapping unit 11 of the packaging machine 6, while the feed unit 7 of the packaging machine 6 remains idle. With the wrapping unit 11 continuing thus to function, a group 10 of packets 2 can be directed toward the gummed blank 8 occupying the final feed position, and the various moving parts 33, 34, 39, 40 and 41 of the folding station 25 then operated to fashion and secure the wrapper 9 in a single cycle of the machine 6 while the group 10 of packets still occupies the mouth of the runout channel 36. Accordingly, the blank 8 occupying the folding station 25 is utilized and runs out in the normal fashion, and no unfinished wrappers 9 remain inside the wrapping unit 11 on termination of the machine cycle. The packaging machine 6 can thus stand still indefinitely without occasioning the loss of any wrapper 9 occupying the runout channel 36.

The equipment 1 shuts off altogether upon completion of the cycle described above, with the emission of the control signal through the terminal denoted 57 and the relative circuit 59, which opens the AND gate 74 to deactivate the main motor 49.

Once a regular supply of packets 2 is restored to the conveyor 3, normal operation of the equipment 1 can be resumed. The relative signal R is generated, whereupon the sensor 65 discontinues the signal through the two circuits 66 and 67 to the AND gates and relays a pulse through the remaining circuit 68 to activate the auxiliary motor 53. Thus, while the rest of the equipment 1 remains at a standstill, the auxiliary motor 53 propels the feed unit 7 through one cycle in such a way that the blank 8 occupying the exit position is advanced through the gumming device 21 into the final feed position. The execution of this cycle corresponds to one full revolution of the secondary shaft 51 about its own axis, whereupon the cam 60 will impinge on and close the switch 61. The resulting control signal is relayed through the three relative circuits 62, 64 and 63 respectively to the auxiliary motor 53, which is shut off, to the control unit 70 of the bistable switch 71, which disengages the second clutch 54 and re-engages the first clutch 52, and to the main motor 49, which is restarted and thus resumes driving the equipment 1 in its entirety.

In an alternative embodiment of the invention (not illustrated), the wrapping unit 11 is such as to accommodate a plurality of pre-gummed blanks 8 at any one time during normal operation. In this instance, needless to say, given that the concept remains that of suspending the operation of the feed unit 7 and allowing a regular utilization and runout of all such gummed blanks 8 as may be occupying the wrapping unit 11, the connections between the encoder 55 and the drive shaft 50 and between the cam 60 and the secondary shaft 51 will be geared down to the point, on the one hand, of allowing the wrapping unit 11 to effect as many cycles as are needed to use up the blanks 8 inside the unit 11, and on the other of allowing the feed unit 7, when driven by the auxiliary motor 53, to effect as many cycles as are needed to replenish the supply of blanks normally held by the wrapping unit 11 before regular operation is resumed.

What is claimed:

1. A method for enveloping generally parallelepiped-shaped groups of packets in outer wrappers, each formed by a respective single sheet of wrapping material gummed to itself and wrapped about a respective group of packets, said method comprising:

(a) supplying a plurality of packets singly and in succession along an infeed conveyor of a packet enveloping equipment, into a wrapping unit of a packaging machine that includes a feed unit, a wrapping unit, and a main drive operably connectable with each of the feed unit and wrapping unit for powering the feed unit and the wrapping unit;

(b) operating said feed unit by connecting power from said main drive to supply sheets of wrapping material singly and in succession along a sheet feeding path from said feed unit to said wrapping unit;

(c) operating said feed unit by connecting power from said main drive to apply adhesive gum in a predetermined pattern to each of said sheets of wrapping material, at a location upstream of said wrapping unit;

(d) operating said wrapping unit by connecting power from said main drive to organize said succession of packets into a succession of generally parallelepiped-shaped groups of packets;

(e) operating said wrapping unit successively upon each said group of packets by connecting power from said main drive for folding a respective said gummed sheet of wrapping material thereabout, so that the respective sheet envelopes the respective group and the adhesive gum on each respective sheet of wrapping material adhesively gums the respective sheet of wrapping material to itself thereby securing the respective sheet of wrapping material as a wrapper about the respective group of packets;

(f) while conducting steps (a)–(e), continually verifying whether step (a) is being successively conducted, and, in the event of thereby sensing an interruption in the supply of said packets in step (a), disconnecting power from said main drive from said feed unit so as to suspend conducting of steps (b) and (c), while continuing to conduct steps (d) and (e) until all gummed sheets of wrapping material which had been supplied to said sensing of said interruption, have been used to wrap respective groups of packets as a result of conducting steps (d) and (e); and then (g) disconnecting power from said main drive from said wrapping unit so as to suspend conducting of steps (d) and (e).

2. The method of claim 1, wherein:

said packaging machine further includes an auxiliary drive operably connectable with said feed unit for powering said feed unit, said method further comprising steps conducted subsequent to step (g), of:

(h) restoring a supply of packets to said infeed conveyor;

(i) operating said feed unit by connecting power from said auxiliary drive to supply sheets of wrapping material, singly and in succession, along said feeding path from said feed unit to said wrapping unit, while said wrapping unit remains disconnected from said main and auxiliary drives;

(j) operating said feed unit by connecting power from said auxiliary drive to apply adhesive gum in said predetermined pattern to each of said sheets of wrapping material, at a location upstream of said wrapping unit, steps (i) and (j) being conducted until as many gummed sheets of wrapping material have been resupplied to said wrapping unit as were put through said wrapping unit as a result of conducting step (e) after said interruption was sensed in step (f); and (k) reverting from conducting steps (h)–(j), to conducting steps (a)–(g).

3. The method of claim 1, wherein:

said packet enveloping equipment further includes a packet-wrapping machine juxtaposed with said infeed conveyor, for providing each packet being conveyed by said infeed conveyor while step (a) is being conducted on the respective said packet, with an individual wrapping of sheet material, said main drive being operably connectable with said packet-wrapping machine for powering said packet-wrapping machine;

said method further comprising, as part of step (a), operating said packet-wrapping machine by connecting power from said main drive to provide each packet being conveyed by said infeed conveyor, with an individual wrapping of sheet material.

4. The method of claim 2, wherein:

said packet enveloping equipment further includes a packet-wrapping machine juxtaposed with said infeed conveyor, for providing each packet being conveyed by said infeed conveyor while step (a) is being conducted on the respective said packet, with an individual wrapping of sheet material, said main drive being operably connectable with said packet-wrapping machine for powering said packet-wrapping machine;

said method further comprising, as part of step (a), operating said packet-wrapping machine by connecting power from said main drive to provide each packet being conveyed by said infeed conveyor, with an individual wrapping of sheet material.

5. The method of claim 4, wherein:

said wrapping unit includes a stop position arranged to define a final feed position for each gummed sheet of wrapping material supplied along said sheet feeding path as a result of conducting step (b) or (i) on the respective said sheet, and a sheet folder including a hollow folder, a hollow fold former, a pusher and a runout channel having a mouth facing said final feed position, said hollow folder, hollow fold former, pusher and runout channel all being juxtaposed with said final feed position and arranged coaxially with one another on an axis which extends transversely of and intersects said sheet feeding path at said final feed position;

said method further comprising as part of step (e):

moving said hollow fold former towards said hollow folder from an opposite side of said final feed position while a respective said gummed sheet of wrapping material is located at said final feed position, thereby displacing said gummed sheet of wrapping material into engagement between said hollow fold former and said hollow folder as a partially folded gummed sheet of gummed wrapping material;

pushing a respective said group of packets through said hollow fold former and said hollow folder so that said group of packets impinges on a central portion of a concave face of said partially folded gummed sheet of wrapping material and said partially folded gummed sheet of wrapping material assumes a substantially U-shaped profile and said group of packets with said partially folded gummed sheet of wrapping material wrapped partially thereabout and having said substantially U-shaped profile, are received together in said runout channel through said mouth of said runout channel;

completing wrapping of said partially folded gummed sheet of wrapping material about said group of packets in said runout channel; and displacing the resultingly wrapped group of packets from said runout channel.

6. The method of claim 5, wherein:

said partially folded gummed sheet of wrapping material of said group of packets with said partially folded gummed sheet of wrapping material wrapped partially about, as received in said runout channel, has gummed end flaps protruding beyond both ends of the respective said group of packets, and two longitudinal flaps, at least one of which is gummed;

said sheet folder further includes two respective end folders each including a top blade and a bottom blade, each said bottom blade being curved along a horizontal axis transverse to said axis so as to recede upwardly; each said bottom blade being coplanar with a respective said top blade and fixed in relation thereto; and said sheet folder further includes a longitudinal top folder and a longitudinal bottom folder, both arranged for vertical reciprocation;

said method further comprising, as part of step (e);

causing respective ones of said end flaps of said partially folded gummed sheet of wrapping material to fold against opposite ends of the respective group of packets by progressive engagement of said end folders with said end flaps; and causing respective ones of said two longitudinal flaps of said partially folded wrapping material to fold against a longitudinal face of said respective group of packets by vertical reciprocation of said top folder and bottom folder.

7. Apparatus for enveloping generally parallelepiped-shaped groups of packets in outer wrappers, each formed by a respective single sheet of wrapping material gummed to itself and wrapped about a respective group of packets, said apparatus comprising:

(a) means for supplying a plurality of packets singly and in succession along an infeed conveyor of a packet enveloping equipment, into a wrapping unit of a packaging machine that includes a feed unit, a wrapping unit, and a main drive operably connectable with each of the feed unit and wrapping unit for powering the feed unit and the wrapping unit;

(b) means for operating said feed unit by connecting power from said main drive to supply sheets of wrapping material singly and in succession along a sheet feeding path from said feed unit to said wrapping unit;

(c) means for operating said feed unit by connecting power from said main drive to apply adhesive gum in a predetermined pattern to each of said sheets of wrapping material, at a location upstream of said wrapping unit;

(d) means for operating said wrapping unit by connecting power from said main drive to organize said succession of packets into a succession of generally parallelepiped-shaped groups of packets;

(e) means for operating said wrapping unit successively upon each said group of packets by connecting power from said main drive for folding a respective said gummed sheet of wrapping material thereabout, so that the respective sheet envelopes the respective group and the adhesive gum on each respective sheet of wrapping material adhesively gums the respective sheet of wrapping material to itself thereby securing the respective sheet of wrapping material as a wrapper about the respective group of packets;

(f) means operably while the respective said means identified (a) and (b) are being operated, for continually verifying whether the respective said means identified in (a) is being successively operated, and, in the event of thereby sensing an interruption in the supply of said packets, for disconnecting power from said main drive from said feed unit so as to suspend supplying sheets of wrapping material along said sheet feeding path and so as to suspend applying gum to the respective said sheets of wrapping material, while continuing to organize said succession of packets into said succession of groups of packets by operating the respective said means identified in (d), and to fold respective gummed sheets of wrapping material about said groups of packets to provide wrappers for said groups by operating the respective said means identified in (e), until all the respective said gummed sheets of wrapping material which had been supplied to said wrapping unit as a result of operating the respective said means identified in (c) prior to said sensing of said interruption, have been used to wrap respective groups of packets as a result of operating the respective said means identified in (d) and (e); and (g) means for disconnecting power from said main drive from said wrapping unit so as to suspend operating the respective said means identified in (d) and (e) when all of the respective gummed sheets of wrapping material which had been supplied to said wrapping unit as a result of operating the respective said means identified in (c) prior to said sensing of said interruption, have been used to wrap respective groups of packets as a result of operating the respective said means identified in (d) and (e).

8. The apparatus of claim 7, wherein:

said packaging machine further includes an auxiliary drive operably connectable with said feed unit for powering said feed unit, so that after a supply of packets to said infeed conveyor has been restored following an interruption, said feed unit can be operated by connecting power from said auxiliary drive to supply sheets of wrapping material single and in succession along said feeding path from said feed unit top said wrapping unit, while said wrapping unit remains disconnected from said main and auxiliary drives and to apply adhesive gum in said predetermined pattern to each of said sheets of wrapping material, at a location upstream of said wrapping unit, until as many gummed sheets of wrapping material have been resupplied to said wrapping unit as were put through said wrapping unit as a result of continuing to wrap respective groups of packets with gummed sheets of wrapping material after said interruption was sensed.

9. The apparatus of claim 7, wherein:

said packet enveloping equipment further includes a packet-wrapping machine juxtaposed with said infeed conveyor, for providing each packet being conveyed by said infeed conveyor with an individual wrapping of sheet material, said main drive being operably connectable with said packet-wrapping machine for powering said packet-wrapping machine.

10. The apparatus of claim 8, wherein:

said packet enveloping equipment further includes a packet-wrapping machine juxtaposed with said infeed conveyor, for providing each packet being conveyed by said infeed conveyor with an individual wrapping of sheet material, said main drive being operably connectable with said packet-wrapping machine for powering said packet-wrapping machine.

11. The apparatus of claim 10, wherein:

said wrapping unit includes a stop position arranged to define a final feed position for each gummed sheet of wrapping material supplied along said sheet feeding path on the respective said sheet, and a sheet folder including a hollow folder, a hollow fold former, a pusher and a runout channel having a mouth facing said final feed position, said hollow folder, hollow fold former, pusher and runout channel all being juxtaposed with said final feed position and arranged coaxially with one another on an axis which extends transversally of and intersects said sheet feeding path at said final feed position, whereby a respective said gummed sheet of wrapping material can be made into a wrapper for a respective said group of packets by;

moving said hollow fold former towards said hollow folder from an opposite side of said final feed position while a respective said gummed sheet of wrapping material is located at said final feed position, thereby displacing said gummed sheet of wrapping material into engagement between said hollow fold former and said hollow folder as a partially folded gummed sheet of gummed wrapping material;

pushing a respective said group of packets through said hollow fold former and said hollow folder so that said group of packets impinges on a central portion of a concave face of said partially folded gummed sheet of wrapping material and said partially folded gummed sheet of wrapping material assumes a substantially U-shaped profile and said group of packets with said partially folded gummed sheet of wrapping material wrapped partially thereabout and having said substantially U-shaped profile, are received together in said runout channel through said mouth of said runout channel;

completing wrapping of said partially folded gummed sheet of wrapping material about said group of packets in said runout channel; and displacing the resultingly wrapped group of packets from said runout channel.

12. The apparatus of claim 11, for use in an instance in which:

said partially folded gummed sheet of wrapping material of said group of packets with said partially folded gummed sheet of wrapping material wrapped partially about, as received in said runout channel has gummed end flaps protruding beyond both ends of the respective said group of packets, and two longitudinal flaps, at least one of which is gummed, wherein:

said sheet folder further includes two respective end folders each including a top blade and a bottom blade, each said bottom blade being curved along a horizontal axis transverse to said axis so as to recede upwardly; each said bottom blade being coplanar with a respective said top blade and fixed in relation thereto; and said sheet folder further includes a longitudinal top folder and a longitudinal bottom folder, both arranged for vertical reciprocation, whereby each wrapper can be formed by:

causing respective ones of said end flaps of said partially folded gummed sheet of wrapping material to fold against opposite ends of the respective group of packets by progressive engagement of said end folders with said end flaps; and causing respective ones of said two longitudinal flaps of said partially folded wrapping material to fold against a longitudinal face of said respective group of packets by vertical reciprocation of said top folder and bottom folder.

* * * * *